US011371774B2

(12) United States Patent
Kagawa et al.

(10) Patent No.: US 11,371,774 B2
(45) Date of Patent: Jun. 28, 2022

(54) MODULE FOR NATURAL GAS LIQUEFACTION DEVICES, NATURAL GAS LIQUEFACTION DEVICE, AND METHOD FOR MANUFACTURING NATURAL GAS LIQUEFACTION DEVICES

(71) Applicant: JGC CORPORATION, Yokohama (JP)

(72) Inventors: Motobumi Kagawa, Kanagawa (JP); Ryo Iwata, Kanagawa (JP)

(73) Assignee: JGC CORPORATION, Kanagawa (JP)

( * ) Notice: Subject to any disclaimer, the term of this patent is extended or adjusted under 35 U.S.C. 154(b) by 438 days.

(21) Appl. No.: 16/497,796

(22) PCT Filed: Jul. 6, 2017

(86) PCT No.: PCT/JP2017/024814
§ 371 (c)(1),
(2) Date: Sep. 26, 2019

(87) PCT Pub. No.: WO2019/008725
PCT Pub. Date: Jan. 10, 2019

(65) Prior Publication Data

US 2020/0300540 A1 Sep. 24, 2020

(51) Int. Cl.
*E04H 5/02* (2006.01)
*F25J 1/00* (2006.01)
*F25J 1/02* (2006.01)

(52) U.S. Cl.
CPC ..... *F25J 1/0022* (2013.01); *E04H 5/02* (2013.01); *F25J 1/0259* (2013.01)

(58) Field of Classification Search
CPC ..... E04H 5/02; F25J 1/0259; F25J 1/0022
See application file for complete search history.

(56) References Cited

U.S. PATENT DOCUMENTS 4,992,669 A * 2/1991 Parmley ..... F01B 1/12 290/1 R
7,221,061 B2 * 5/2007 Alger ..... H02J 9/08 290/1 R (Continued)

FOREIGN PATENT DOCUMENTS

| | | |
|---|---|---|
| JP | 2016514823 | 5/2016 |
| WO | 2014028961 | 2/2014 |
| WO | 2017062155 | 4/2017 |

OTHER PUBLICATIONS

"International Search Report (Form PCT/ISA/210) of PCT/JP2017/024814," dated Sep. 5, 2017, with English translation thereof, pp. 1-3.

*Primary Examiner* — Paola Agudelo
(74) *Attorney, Agent, or Firm* — JCIP Global Inc.

(57) ABSTRACT

The module for a natural gas liquefaction apparatus includes: a frame configured to accommodate a device group forming a part of the natural gas liquefaction apparatus; an annex building, which is provided separately from the frame, and is configured to accommodate at least one of a power supply apparatus or a control information output device; and a coupling member, which is configured to couple the frame and the annex building to each other so as to enable the frame and the annex building to be transported as one unit at a time of transportation of the module for a natural gas liquefaction apparatus, and is removed so as to separate the frame and the annex building from each other at a time of installation of the module for a natural gas liquefaction apparatus in a construction site of the natural gas liquefaction apparatus.

6 Claims, 4 Drawing Sheets

(56) References Cited

U.S. PATENT DOCUMENTS

| | | | | |
|---|---|---|---|---|
| 8,587,136 | B2 * | 11/2013 | Williams | F01K 13/00 290/1 R |
| 9,945,142 | B2 * | 4/2018 | Maselli | E04H 5/02 |
| 2009/0223144 | A1 * | 9/2009 | Leahy | E04B 1/34321 52/745.02 |
| 2009/0229194 | A1 * | 9/2009 | Armillas | H05K 7/1497 211/162 |
| 2010/0170277 | A1 * | 7/2010 | Schmitt | H05K 7/20745 165/104.34 |
| 2011/0240265 | A1 * | 10/2011 | Dechene | H05K 7/20745 165/104.31 |
| 2014/0137486 | A1 * | 5/2014 | Driess | E04H 5/00 52/745.03 |
| 2016/0010916 | A1 * | 1/2016 | Byfield | B63B 35/44 62/611 |
| 2016/0109179 | A1 * | 4/2016 | McCarthy | H02J 3/00 307/18 |
| 2017/0306610 | A1 * | 10/2017 | Leahy | E04C 2/526 |

* cited by examiner

MODULE FOR NATURAL GAS LIQUEFACTION DEVICES, NATURAL GAS LIQUEFACTION DEVICE, AND METHOD FOR MANUFACTURING NATURAL GAS LIQUEFACTION DEVICES

CROSS-REFERENCE TO RELATED APPLICATION

This application is a 371 application of the international PCT application serial no. PCT/JP2017/024814, filed on Jul. 6, 2017. The entirety of the abovementioned patent application is hereby incorporated by reference herein and made a part of this specification.

TECHNICAL FIELD

The present invention relates to a technology for constructing a natural gas liquefaction apparatus configured to liquefy natural gas.

BACKGROUND ART

A natural gas liquefaction apparatus (NG liquefaction apparatus) is a facility configured to cool and liquefy natural gas (NG) produced in a gas well or the like to produce liquefied natural gas (LNG).

In recent years, in construction of the NG liquefaction apparatus, an attempt has been made to modularize the NG liquefaction apparatus by dividing a large number of devices forming the NG liquefaction apparatus into blocks and incorporating a device group of each of the blocks into a common frame (for example, Patent Literature 1). A module for constructing an NG liquefaction apparatus is hereinafter referred to as "module for a natural gas liquefaction apparatus (module for an NG liquefaction apparatus)".

For example, the module for an NG liquefaction apparatus is built at another place. The module for an NG liquefaction apparatus is transported to a construction site of the NG liquefaction apparatus and installed therein. Then, a plurality of modules for an NG liquefaction apparatus are combined to configure the NG liquefaction apparatus.

In a frame forming the module for an NG liquefaction apparatus, there are installed a large number of devices, such as devices (power consumption devices) configured to receive supply of electric power for drive from outside and devices (devices to be controlled) to be subjected to operation control based on a control signal.

Regarding the supply of electric power to the power consumption devices, a substation room including a transformer configured to transform a voltage, a feed control equipment configured to control power feed to each of the power consumption devices, and power supply apparatus such as a breaker or a disconnecter is provided in parallel to the module for an NG liquefaction apparatus in some cases.

In addition, regarding the operation control of the device to be controlled, an instrument control room including a control information output device is provided in parallel to the module for an NG liquefaction apparatus in some cases. The control information output device is configured to output information on the operation control of the device to be controlled, such as a flow rate setting value, a pressure setting value, and a temperature setting value, which are received from an operator, to a controller configured to perform the operation control of the device to be controlled in a center control room configured to perform overall control of the entire NG liquefaction apparatus, and is configured to output information on, for example, a flow rate, a pressure, and a temperature to be controlled through use of the device to be controlled to the center control room.

With regard to a case in which the substation room and the instrument control room (hereinafter sometimes collectively referred to as "annex building") are provided in parallel to the module for an NG liquefaction apparatus as described above, in Patent Literature 1, there is no disclosure of a technology involving efficiently combining the frame having the device group incorporated therein with the annex building to build the module for an NG liquefaction apparatus and transporting the module for an NG liquefaction apparatus to a construction site to construct the NG liquefaction apparatus.

CITATION LIST

Patent Literature

[PTL 1] WO 2014/028961 A1

SUMMARY OF INVENTION

Technical Problem

The present invention has been made in view of the above-mentioned circumstances and provides a module for a natural gas liquefaction apparatus, which can be easily transported and installed in a construction site.

Solution to Problem

According to one embodiment of the present invention, there is provided a module for a natural gas liquefaction apparatus, including: a frame configured to accommodate a device group forming a part of the natural gas liquefaction apparatus; an annex building, which is provided separately from the frame, and is configured to accommodate at least one of a power supply apparatus configured to supply electric power to a power consumption device included in the device group or a control information output device configured to output, to a controller that is included in the device group and configured to perform operation control of a device to be controlled through use of a control signal, information on the operation control; and a coupling member, which is configured to couple the frame and the annex building to each other so as to enable the frame and the annex building to be transported as one unit at a time of transportation of the module for a natural gas liquefaction apparatus, and is removed so as to separate the frame and the annex building from each other at a time of installation of the module for a natural gas liquefaction apparatus in a construction site of the natural gas liquefaction apparatus.

The module for a natural gas liquefaction apparatus may have the following features.

(a) The module for a natural gas liquefaction apparatus is in a state in which the frame and the annex building are coupled to each other through the coupling member. When the power supply apparatus is provided in the annex building, the power supply apparatus and the power consumption device to which electric power is supplied are connected to each other through a feeder line. When the control information output device is provided in the annex building, the control information output device and the controller to which the information on the operation control is output are connected to each other through a signal line.

(b) The coupling member is configured to couple a side surface of the frame and a side surface of the annex building to each other so that the frame and the annex building are arranged at installation positions, respectively, when the module for a natural gas liquefaction apparatus is installed in the construction site, and the coupling member is removed.

(c) The annex building has a blastproof structure, and the frame is free of the blastproof structure.

Moreover, the natural gas liquefaction apparatus includes a plurality of modules for a natural gas liquefaction apparatus, each being installed under a state in which the coupling member is removed.

Further, according to one embodiment of another invention, there is provided a method of manufacturing a natural gas liquefaction apparatus, including: constructing a module for a natural gas liquefaction apparatus, the module for a natural gas liquefaction apparatus including: a frame configured to accommodate a device group forming a part of the natural gas liquefaction apparatus; an annex building, which is provided separately from the frame, and is configured to accommodate at least one of a power supply apparatus configured to supply electric power to a power consumption device included in the device group or a control information output device configured to output, to a controller that is included in the device group and configured to perform operation control of a device to be controlled through use of a control signal, information on the operation control; and a coupling member, which is configured to couple the frame and the annex building to each other so as to enable the frame and the annex building to be transported as one unit at a time of transportation of the module for a natural gas liquefaction apparatus; transporting the module for a natural gas liquefaction apparatus from a constraction site of the module for a natural gas liquefaction apparatus to a construction site of the natural gas liquefaction apparatus; and separating the frame and the annex building from each other by removing the coupling member at a time of installing the module for a natural gas liquefaction apparatus, which has been transported to the construction site, in the construction site.

The method of manufacturing the natural gas liquefaction apparatus may have the following features.

(d) The constructing a module for a natural gas liquefaction apparatus includes; connecting, when the power supply apparatus is provided in the annex building, the power supply apparatus and the power consumption device to which electric power is supplied to each other through a feeder line; connecting, when the control information output device is provided in the annex building, the control information output device and the controller to which the information on the operation control is output to each other through a signal line.

(e) The coupling member is configured to couple a side surface of the frame and a side surface of the annex building to each other, and, when the coupling member is removed in the separating the frame and the annex building from each other, the frame and the annex building are arranged at installation positions, respectively.

(f) The constructing a module for a natural gas liquefaction apparatus includes: configuring the annex building having a blastproof structure; and configuring the frame with a steel frame structure free of the blastproof structure.

Advantageous Effects of Invention

In the present invention, the frame configured to accommodate the device group forming a part of the natural gas liquefaction apparatus and the annex building configured to accommodate the power supply apparatus or the control information output device are coupled to each other through the coupling member. Therefore, at a time of transportation of the module for a natural gas liquefaction apparatus, the frame and the annex building can be easily transported as one unit.

In addition, after the module for a natural gas liquefaction apparatus is installed in the construction site of the natural gas liquefaction apparatus, the frame and the annex building are separated from each other by removing the coupling member. Therefore, designing and building of a structure of the module for a natural gas liquefaction apparatus can be performed under the condition including less constraints without being influenced by a difference in design standard and the like.

DESCRIPTION OF EMBODIMENTS

Figure 1:
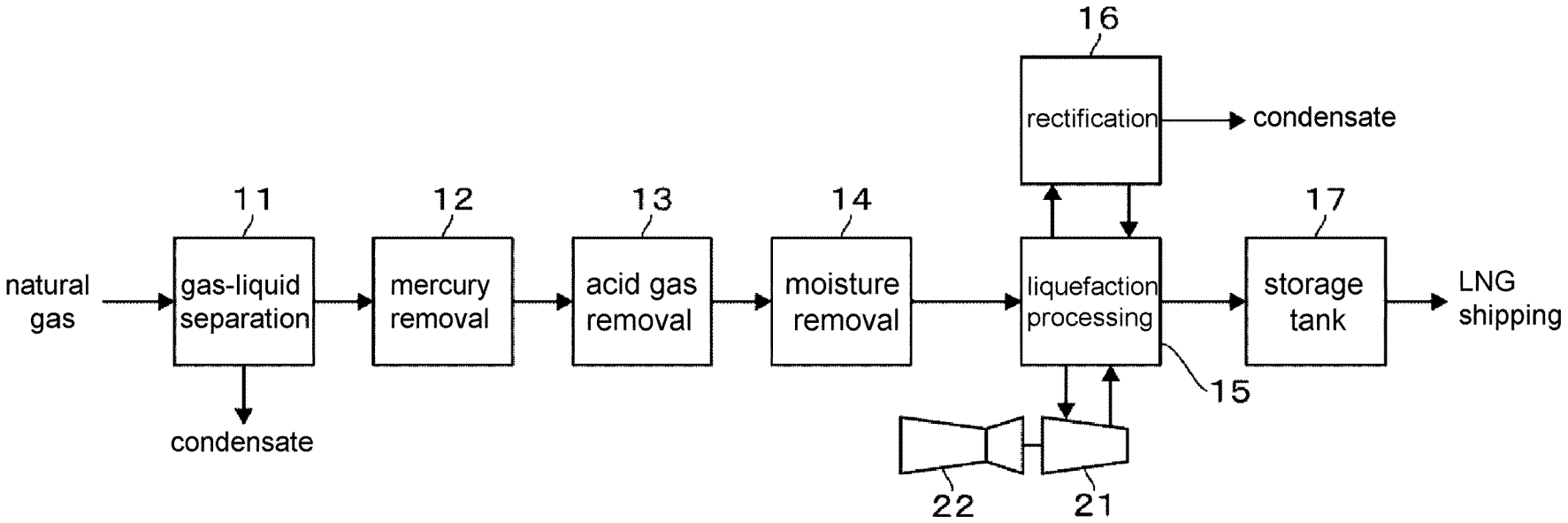
FIG. 1 is a diagram for illustrating a configuration example of each processing unit included in a natural gas liquefaction apparatus.

FIG. 1 is a diagram for illustrating one example of a schematic configuration of a natural gas (NG) liquefaction apparatus that is configured through use of a module for a natural gas liquefaction apparatus according to an embodiment of the present invention.

The NG liquefaction apparatus includes a gas-liquid separation unit 11, a mercury removal unit 12, an acid gas removal unit 13, a dehydration unit 14, a liquefaction process unit 15, and a storage tank 17. The gas-liquid separation unit 11 is configured to separate a liquid from NG. The mercury removal unit 12 is configured to remove mercury from the NG. The acid gas removal unit 13 is configured to remove acid gas, such as carbon dioxide and hydrogen sulfide, from the NG. The dehydration unit 14 is configured to remove a trace amount of moisture contained in the NG. The liquefaction process unit 15 is configured to cool and liquefy the NG having those impurities removed therefrom to obtain LNG. The storage tank 17 is configured to store the liquefied LNG.

The gas-liquid separation unit 11 is configured to separate a condensate, which is a liquid at normal temperature, contained in the NG transported through a pipeline or the like. For example, the gas-liquid separation unit 11 includes a device group including, for example, an elongated pipe and a drum, a regeneration column and a reboiler of an antifreeze liquid, and supplementary facilities thereof. The elongated pipe and the drum are arranged so as to be inclined, and are configured to separate a liquid from the NG through use of a difference in specific gravity. The regeneration column and the reboiler of an antifreeze liquid are configured to regenerate and heat an antifreeze liquid to be added as necessary in order to prevent clogging in the pipeline in the process of transportation.

The mercury removal unit 12 is configured to remove a trace amount of mercury contained in the NG having the liquid separated therefrom. For example, the mercury removal unit 12 includes a device group including, for example, a mercury adsorption column in which a mercury removal agent is filled in an adsorption column and supplementary facilities thereof.

The acid gas removal unit 13 is configured to remove acid gas, such as carbon dioxide and hydrogen sulfide, which are liable to be solidified in LNG at a time of liquefaction. As a method of removing the acid gas, there are given a procedure using a gas absorbing liquid containing an amine compound or the like and a procedure using a gas separation membrane that allows acid gas in the NG to pass therethrough.

When the gas absorbing liquid is adopted, the acid gas removal unit 13 includes a device group including, for example, an absorption column, a regeneration column, a reboiler, and supplementary facilities thereof. The absorption column is configured to bring the NG and the gas absorbing liquid into countercurrent contact with each other. The regeneration column is configured to regenerate the gas absorbing liquid having absorbed the acid gas. The reboiler is configured to heat the gas absorbing liquid in the regeneration column.

In addition, when the gas separation membrane is adopted, the acid gas removal unit 13 includes a device group including, for example, a gas separation unit configured to accommodate a large number of hollow fiber membranes in a main body and supplementary facilities thereof.

The dehydration unit 14 is configured to remove a trace amount of moisture contained in the NG. For example, the dehydration unit 14 includes a device group including, for example, a plurality of adsorption columns, a heater, and supplementary facilities thereof. In the plurality of adsorption columns, an adsorbent, such as a molecular sieve or silica gel, is filled, and a moisture removing operation of the NG and a regeneration operation of the adsorbent having adsorbed moisture are alternately switched to be performed. The heater is configured to heat regeneration gas (for example, the NG having the moisture removed therefrom) for the adsorbent supplied to the adsorption column in which the regeneration operation is performed.

The NG having the impurities removed therefrom by various removal units 11 to 14 described above is supplied to the liquefaction process unit 15 to be liquefied. The liquefaction process unit 15 includes devices such as a precooling heat exchanger, a scrub column, a main cryogenic heat exchanger (MCHE), a refrigerant compressor 21, and supplementary facilities thereof. The precooling heat exchanger is configured to precool the NG with precooling refrigerant containing propane as a main component. The scrub column is configured to remove a heavy component from the precooled NG. The main cryogenic heat exchanger (MCHE) is configured to cool, liquefy, and subcool the NG with mixed refrigerant containing a plurality of kinds of refrigerant raw materials, such as nitrogen, methane, ethane, and propane. The refrigerant compressor 21 is configured to compress gas of the precooling refrigerant and the mixed refrigerant that are gasified by heat exchange.

In FIG. 1, each of the above-mentioned devices is not shown except that individual refrigerant compressors (low-pressure MR compressor and high-pressure MR compressor for mixed refrigerant, and C3 compressor for precooling refrigerant) of the precooling refrigerant and the mixed refrigerant are collectively described as one component.

In addition, in FIG. 1, there is illustrated an example using a gas turbine 22 as a power source configured to drive refrigerant compressors 21, but a motor or the like may be used in accordance with the scale of the refrigerant compressors 21.

In addition, in a subsequent stage of each of the refrigerant compressors 21 of the liquefaction process unit 15, there are provided a large number of air-cooled heat exchangers (ACHEs) 41 configured to cool a fluid handled in the NG liquefaction apparatus. The air-cooled heat exchangers (ACHEs) 41 form various coolers configured to cool compressed refrigerant and a condenser, and a cooler and the like configured to cool the gas absorbing liquid regenerated in the regeneration column and a column top liquid in a case in which the acid gas removal unit 13 uses the gas absorbing liquid.

Further, a rectifying unit 16 is provided in parallel to the liquefaction process unit 15. The rectifying unit 16 includes a deethanizer configured to separate ethane from a liquid (liquid heavy component) separated from the cooled NG, a depropanizer configured to separate propane from the liquid having ethane separated therefrom, and a debutanizer configured to separate butane from the liquid having propane separated therefrom to obtain a condensate that is a liquid at normal temperature. The deethanizer, the depropanizer, and the debutanizer each include a device group including, for example, a rectifying column configured to rectify each component, a reboiler configured to heat the liquid in each rectifying column, and supplementary facilities thereof. The rectifying unit 16 corresponds to a heavy component removal unit in the embodiment of the present invention.

Liquefied natural gas (LNG), which has been liquefied and subcooled in the liquefaction process unit 15, is fed to and stored in the storage tank 17. The LNG stored in the storage tank 17 is fed with an LNG pump (not shown) and shipped to an LNG tanker or a pipeline.

In addition, in the NG liquefaction apparatus, there are also installed device groups including, for example, an oil heater, a boiler, and the like configured to perform various heating operations performed in each of the above-mentioned removal units 11 to 16 and perform heating of a heat medium (for example, hot oil, vapor, or the like) supplied to a heater configured to prevent freezing of the ground surface or the like, which is provided on a bottom surface of the storage tank 17, and supplementary facilities thereof, and a gas turbine generator and a gas engine generator configured to supply electric power to be consumed in the NG liquefaction apparatus, and supplementary facilities thereof.

Figure 2:
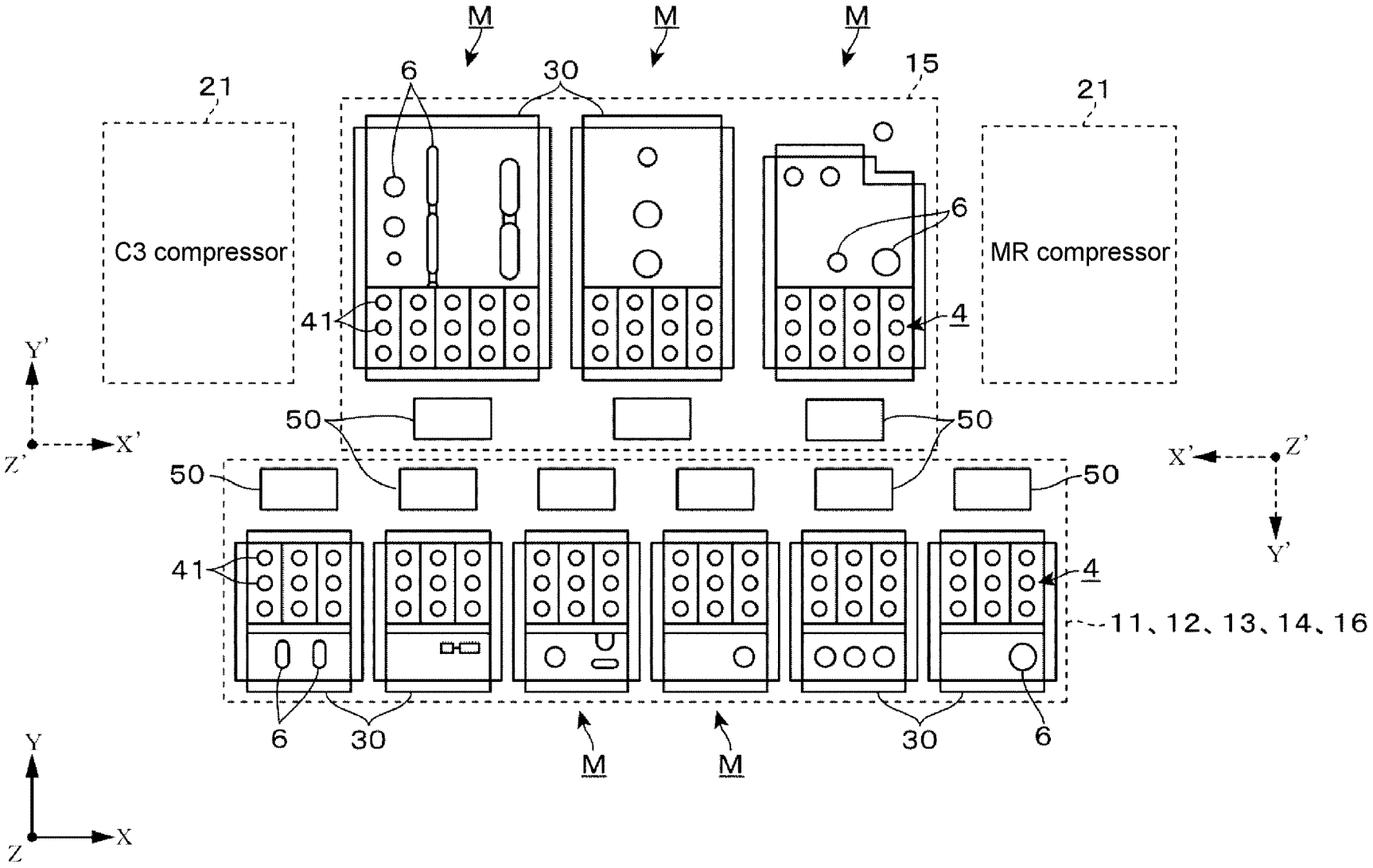
FIG. 2 is a plan view for illustrating a layout example of modules for a natural gas liquefaction apparatus to be arranged in the natural gas liquefaction apparatus.

FIG. 2 is a view for illustrating one example of layout of the above-mentioned NG liquefaction apparatus. The NG liquefaction apparatus according to this embodiment is configured by combining a plurality of modules M for an NG liquefaction apparatus (hereinafter sometimes simply referred to as "modules M") each configured to accommodate a device group (for example, devices 6 in a frame and ACHEs 41) forming each of the removal units 11 to 16 in a common frame 30.

In the example illustrated in FIG. 2, the device group forming the liquefaction process unit 15 is further divided into a plurality of groups, and the plurality of modules M each configured to accommodate the device group in each divided group in the frame 30 are provided. In addition, each device group (devices 6 in a frame and ACHEs 41) forming the other removal units 11, 12, 13, 14, and 16, the oil heater, the boiler and the like is also divided into groups, for example, on the basis of the removal units 11, 12, 13, 14, and 16, and the plurality of modules M each configured to accommodate the device group in each divided group in the frame 30 are provided.

In addition, as illustrated in FIG. 2, the plurality of modules M on the liquefaction process unit 15 side are arrayed in a horizontal direction, and the modules M associated with the other removal units 11, 12, 13, 14, 16, and the like are arrayed in the horizontal direction. The modules M in two rows form the NG liquefaction apparatus. In addition, the refrigerant compressors 21 that are an MR compressor and a C3 compressor are arranged on both sides of the row of the modules M of the liquefaction process unit 15.

In the following description, an origin side of the Y-axis in the coordinate axes represented by the solid lines in FIG. 2 is referred to as "front side", and an arrow direction side thereof is referred to as "back side". In addition, the sub-coordinate axes represented by the broken lines in FIG. 2 to FIG. 4 represent directions in which focus is given on each of the modules M. An origin side of the Y'-axis in the sub-coordinate axes is referred to as "rear end side", and an arrow direction side thereof is referred to as "distal end side".

Figure 3A:
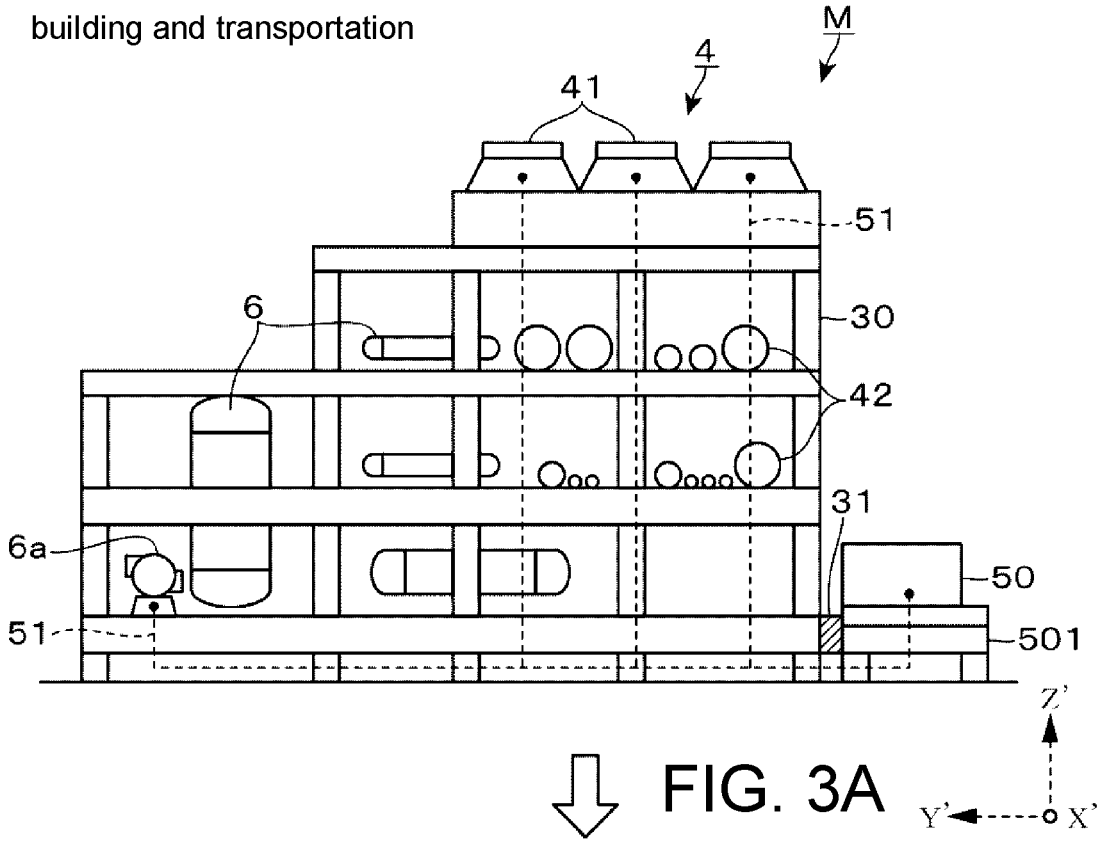
FIG. 3A and FIG. 3B are side views of a module for a natural gas liquefaction apparatus according to an embodiment of the present invention.
Figure 3B:
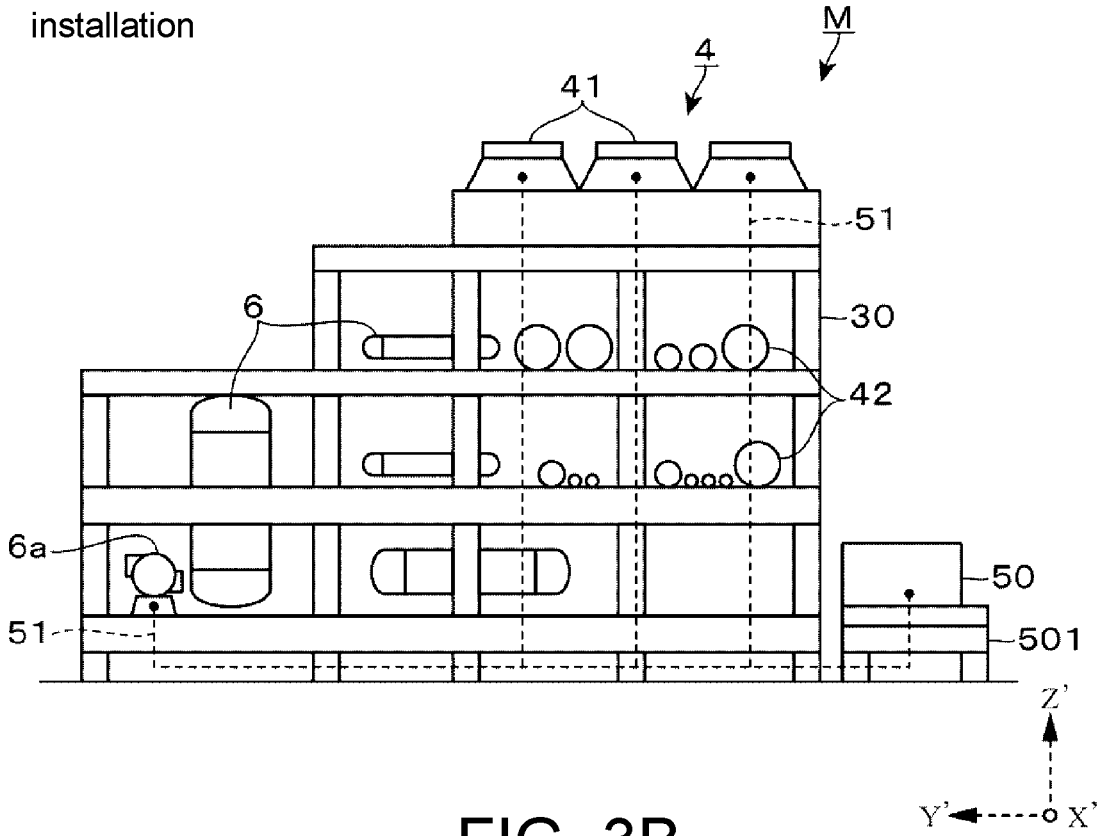
Figure 4:
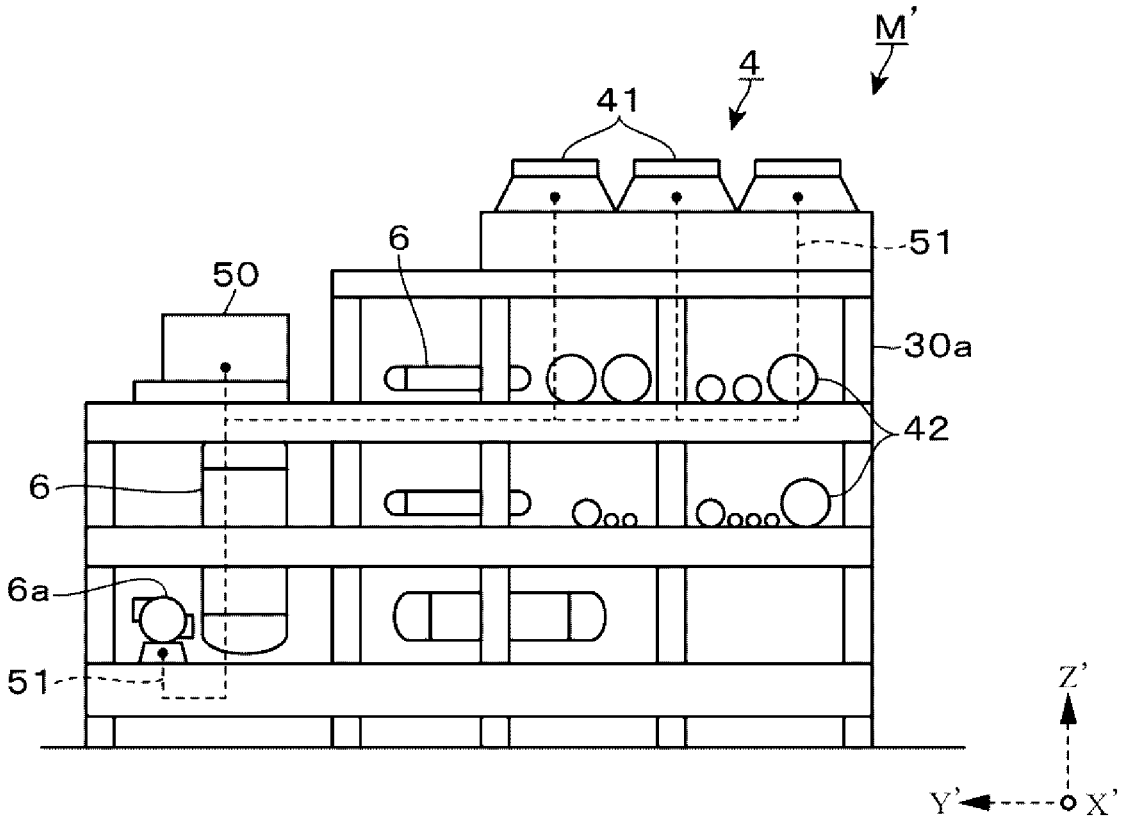
FIG. 4 is a side view of a module for a natural gas liquefaction apparatus according to a comparative embodiment.

As illustrated in FIG. 2, FIG. 3A and FIG. 3B, the frame 30 forming each of the modules M is formed so as to have a substantially rectangular shape in plan view, and is a steel frame structure that enables the devices included in the device group of each of the removal units 11 to 16 to be arranged in multiple layers in a vertical direction.

There is provided a row in which the plurality of ACHEs 41 are arrayed along the Y'-axis direction directed from the rear end side to the distal end side on an upper surface of the frame 30. Further, a plurality of rows of the ACHEs 41 are provided (for convenience of illustration, there is illustrated an example of three rows in FIG. 2) in a width direction of the frame 30, and thus, a large number of ACHE groups 4 are arranged. The ACHEs 41 form a part of the device group in each of the removal units 11 to 16.

As illustrated in FIG. 3A, in a space on a lower side of an area in which the ACHE group 4 is arranged, there is a pipe rack in which a large number of pipes 42, through which a fluid transferred between the removal units 11 to 16 flows, are arranged. The pipes 42 also form a part of the device group in each of the removal units 11 to 16.

In addition, on the lower side of the pipes 42 arranged in the pipe rack and in a space on a distal end side from the pipe rack, the devices 6 in a frame forming a part of the device group in each of the removal units 11 to 16 are arranged together with the above-mentioned ACHEs 41. The device 6 in a frame include static devices such as a column, a tank, and a heat exchanger, dynamic devices such as a pump 6*a*, connection pipes (not shown) configured to connect the static devices and the dynamic devices to each other and connect the static devices and the dynamic devices and the pipes 42 on the pipe rack side to each other, and the like.

In the module M having the above-mentioned configuration, of the devices accommodated in the frame 30, power consumption devices that consume electric power for drive, such as the ACHEs 41 and the pump 6*a*, are supplied with electric power transformed in accordance with a rated voltage of each of the power consumption devices through feeder lines.

In view of the foregoing, a substation room including a transformer configured to transform a voltage, a feed control equipment configured to control power feed to each of the power consumption devices, and the power supply apparatus such as a breaker or a disconnector is provided in parallel to the frame 30 configured to accommodate the power consumption devices.

Further, various devices accommodated in the frame 30 include various devices to be controlled, for example, control valves such as a flow rate control valve configured to regulate a flow rate of a fluid, a pressure control valve configured to regulate a pressure in the tower and the column, and a flow rate control valve configured to increase or decrease a flow rate of a heat medium and refrigerant in order to adjust a heat exchanger outlet for the fluid to be adjusted for temperature, and an on-off value that is opened or closed in accordance with a liquid level in the tower and the tank.

Controllers are provided in parallel to the devices to be controlled. The controllers are configured to output control signals to the devices to be controlled based on the results obtained by detection in a detection unit, such as a flow rate, a pressure, a temperature, and a liquid level of the fluid, to thereby perform the operation control of each of the devices to be controlled. Thus, a control loop is constructed.

In this case, an instrument control room configured to accommodate a control information output device, which is called a field control station (FCS) or the like, is also provided in parallel to the frame 30 configured to accommodate the devices associated with the control loop in some cases. The control information output device is configured to output information on the operation control of the device to be controlled, such as a flow rate setting value, a pressure setting value, and a temperature setting value, which are received from an operator, to the controller configured to perform the operation control of the device to be controlled in a center control room configured to perform overall control of the entire NG liquefaction apparatus, and is configured to output information on, for example, a flow rate, a pressure, a temperature, and a liquid level of the fluid detected in the detection unit to the center control room.

The control information output device and the controller of each of the devices to be controlled and the detection unit are connected to each other through signal lines. In addition, in the following description, the substation room and the instrument control room are also referred to as "annex building 50".

Next, consideration is made of a procedure for providing the annex building 50 in parallel to the frame 30.

In construction of the NG liquefaction apparatus, the following operation is performed. The module M is built in a factory or the like, which is different from the construction site of the NG liquefaction apparatus, and the completed module M is transported to the construction site by a carrying vessel or a transport vehicle. After that, the module M is installed in the construction site.

Meanwhile, as described above, the power supply apparatus in the annex building 50 and the power consumption devices in the frame 30 are connected to each other through the feeder lines. In addition, the control information output device in the annex building 50 and the controller of each of the devices to be controlled and the detection unit in the frame 30 are connected to each other through the signal lines.

Therefore, when the frame 30 and the annex building 50 are built together at a time of building of the module M, and connection of the feeder lines and the signal lines is completed, the man-hour after installation of the module M in the construction site can be significantly reduced as compared to a case in which the frame 30 and the annex building 50 are separately transported to be installed in the construction site, and connection operation of the feeder lines and the signal lines is performed.

From the above-mentioned viewpoint, as illustrated in FIG. 4, it is conceivable to configure a module M' in which the annex building 50 is also accommodated in a frame 30*a* together with another device group (ACHEs 41 and devices 6 in a frame).

In the module M' illustrated in FIG. 4, there is illustrated an example in which the annex building 50 that is the substation room is arranged on an upper surface on a distal end side of the frame 30*a*. In the module M', the power supply apparatus in the annex building 50 and the ACHEs 41 and the pump 6*a* that are the power consumption devices are connected to each other through feeder lines 51 schematically represented by the broken lines.

When the module M' having the above-mentioned configuration is built, and the frame 30*a* and the annex building 50 are transported as one unit and installed in the construction site, the connection operation of the feeder lines and the signal lines is substantially not required, and hence the man-hour after that can be significantly reduced.

However, in the NG liquefaction apparatus configured to handle a combustible liquid and a cryogenic liquid, the annex building including the devices (power supply apparatus and control information output devices) configured to perform important control of the NG liquefaction apparatus is required to be designed as a building that can withstand blast impact at a time of an accident, and the annex building 50 and a structure configured to support the annex building 50 are required to have a blastproof structure in some cases.

In this case, when the annex building 50 is arranged on the upper surface of the frame 30*a* as illustrated in FIG. 4, it is required to configure the frame 30*a* through use of a steel having a larger cross-section in order to support a blastproof load of the annex building 50. Also in this respect, the module M' illustrated in FIG. 4 has a configuration in which building cost is liable to rise.

For example, when the annex building 50 is arranged in a space on the lower side of the pipes 42 on a rear end side of the frame 30*a* instead of the example of FIG. 4 in which the annex building 50 is arranged on the upper surface of the frame 30*a*, the range in which the cross-section of a steel member of the frame 30*a* for supporting the blastproof load of the annex building 50 is required to be enlarged can be limited to only a low layer portion. However, a strong frame structure having a large range is still required, and it is required that the annex building be mounted in the frame 30*a* before installation of the pipes 42 in terms of a building step. Thus, there also arises a new problem in that the step management becomes difficult.

In view of the problems considered as described above, the module M in this embodiment adopts a configuration in which a side surface of the frame 30 configured to accommodate the device group (for example, devices 6 in a frame, ACHEs 41) and a side surface of the annex building 50 are coupled to each other through a coupling member 31.

More specifically, as illustrated in FIG. 3A, the module M in this embodiment has a structure in which the annex building 50 is arranged at a side position on the rear end side of the frame 30 in conformity with the positional relationship after installation in the construction site, and a side surface of the frame 30 and a side surface of a base frame 501 configured to support the annex building 50 are coupled to each other through the coupling member 31.

For example, the coupling member 31 is formed of a steel member and has a width dimension of from several tens of centimeters to several meters in a front-and-back direction in conformity with an interval between the frame 30 and the annex building 50 (base frame 501). Regarding the connection of the steel forming the frame 30, the coupling member 31, and the base frame 501, a plurality of methods such as connection methods using a bolt structure and a welding structure are conceivable in view of a transport load, removal operation in the construction site, and the like.

Further, at a time of building of the module M, the power consumption devices in the frame 30 and the power supply apparatus in the annex building 50 that is the substation room are connected to each other through the feeder lines 51. In addition, the controller of each of the device to be controlled and the detection unit in the frame 30 and the control information output device in the annex building 50 that is the instrument control room are connected to each other through the signal lines.

In FIG. 3A and FIG. 3B, there is illustrated a state in which the power supply apparatus in the annex building 50 that is the substation room and the ACHEs 41 and the pump 6*a* that are the power consumption devices are connected to each other through the feeder lines 51 represented by the broken lines.

Based on the above-mentioned plan, the module M is built under a state in which the predetermined device groups are installed in the frame 30 and the annex building 50, the devices are connected to each other through the feeder lines 51 and the signal lines, and further, the frame 30 and the annex building 50 are coupled to each other through the coupling member 31 in a factory different from the construction site of the NG liquefaction apparatus or the like (FIG. 3A).

The module M that has been build is transported to the construction site through use of a carrying vessel or a transport vehicle under a state in which the frame 30 and the annex building 50 are coupled to each other as one unit (FIG. 3A).

The module M is arranged on a foundation laid in advance on the construction site of the NG liquefaction apparatus, and a lower end portion of the frame 30 and a lower end portion of the base frame 501 of the annex building 50 are fixed to the foundation to install the module 30.

In this case, as described above, the frame 30 and the annex building 50 are coupled to each other in conformity with the positional relationship after installment to the construction site. Therefore, the frame 30 and the annex building 50 can be arranged at accurate positions merely by transporting the module M to a position set in advance.

After that, the coupling member 31 coupling the steel forming the frame 30 and the base frame 501 to each other is removed. As a result, as illustrated in FIG. 3B, the frame 30 and the annex building 50 forming the module M as one unit are installed under a state of being separated from each other.

There is no particular limitation on the order of removing the coupling member 31. After the module M is transported to the vicinity of the installation position, the coupling member 31 may be separated, and the frame 30 and the annex building 50 may be accurately aligned with each other.

In this case, the annex building 50 separated from the frame 30 is installed at a position which is outside the frame 30 and is away from the frame 30 by a required distance. As a result, the blastproof structure required in the annex building 50 and the base frame 501 configured to support the annex building 50 is limited to only this range, and it is not required that the frame 30 have a blastproof structure.

Based on the above-mentioned procedure, the plurality of modules M corresponding to the removal units 11 to 16 are installed at predetermined positions, respectively, and further, another device such as the refrigerant compressor 21 is installed.

In the example illustrated in FIG. 2, the plurality of modules M are arrayed in two rows on the front side and the back side under a state in which the annex buildings 50 arranged on the rear end side of each of the frames 30 are opposed to each other. However, the annex buildings 50 may be arranged on the distal end side of each of the frames 30.

In FIG. 2, there is illustrated an example in which one annex building 50 is provided with respect to each of the frames 30. However, the modules M may be built and transported under a state in which the plurality of annex buildings 50 for the substation room and the instrument control room are coupled to the frame 30.

Each of the modules M is installed at a predetermined position, and the coupling member 31 is removed. The pipes are connected between the modules M and between the modules M and the devices outside the modules M. The feeder line is connected from a power generation facility or the like to each of the annex buildings 50 that are the substation rooms. The signal line is connected between the center control room and each of the annex buildings 50 that are the instrument control rooms. Thus, the NG liquefaction apparatus can be configured.

The module M in this embodiment has the following effects.

The frame 30 configured to accommodate the device group forming a part of the natural gas liquefaction apparatus and the annex building 50 configured to accommodate the power supply apparatus or the control information output device are coupled to each other through the coupling member 31. Therefore, at a time of transportation of the module M, the frame 30 and the annex building 50 can be easily transported as one unit.

In addition, after the module M is installed in the construction site of the natural gas liquefaction apparatus, the frame 30 and the annex building 50 are separated from each other by removing the coupling member 31. Therefore, designing and building of a structure of the module M can be performed under the condition including less constraints without being influenced by a difference in design standard and the like.

Here, in the example illustrated in FIG. 3A, there is illustrated a case in which the annex building 50 is arranged outside the frame 30, and the side surface of the frame 30 and the side surface of the annex building 50 (base frame 501) are coupled to each other through the coupling member 31. The coupling position of the annex building 50 with respect to the frame 30 is not limited to this case.

For example, when the above-mentioned problem of the step management is solved, the module M in which the frame 30 and the annex building 50 are coupled to each other through the coupling member 31 may be built under a state in which the annex building 50 is accommodated in the frame 30 (for example, the space on the lower side of the pipes 42). In this case, the module M can be transported in a more compact state.

The invention claimed is:

1. A module for a natural gas liquefaction apparatus, comprising:

a frame configured to accommodate a device group forming a part of the natural gas liquefaction apparatus;

an annex building, which is provided separately from the frame, and is configured to accommodate at least one of a power supply apparatus configured to supply electric power to a power consumption device included in the device group or a control information output device configured to output, to a controller that is included in the device group and configured to perform operation control of a device to be controlled through use of a control signal, information on the operation control; and a coupling member, which is configured to removably couple a side surface of the frame and a side surface of the annex building to each other so as to enable the frame and the annex building to be transported as one unit arranged at installation positions at a time of transportation of the module for a natural gas liquefaction apparatus.

2. The module for a natural gas liquefaction apparatus according to claim 1, the module for a natural gas liquefaction apparatus being in a state in which the frame and the annex building are coupled to each other through the coupling member, wherein, when the power supply apparatus is provided in the annex building, the power supply apparatus and the power consumption device to which electric power is supplied are connected to each other through a feeder line, and wherein, when the control information output device is provided in the annex building, the control information output device and the controller to which the information on the operation control is output are connected to each other through a signal line.

3. The module for a natural gas liquefaction apparatus according to claim 1, wherein the annex building has a blastproof structure, and the frame does not have a blastproof structure.

4. A method of manufacturing a natural gas liquefaction apparatus, comprising:

constructing a module for a natural gas liquefaction apparatus, the module for a natural gas liquefaction apparatus including:

a frame configured to accommodate a device group forming a part of the natural gas liquefaction apparatus;

an annex building, which is provided separately from the frame, and is configured to accommodate at least one of a power supply apparatus configured to supply electric power to a power consumption device included in the device group or a control information output device configured to output, to a controller that is included in the device group and configured to perform operation control of a device to be controlled through use of a control signal, information on the operation control; and a coupling member, which is configured to couple a side surface of the frame and a side surface of the annex building to each other so as to enable the frame and the annex building to be transported as one unit at a time of transportation of the module for a natural gas liquefaction apparatus;

transporting the module for a natural gas liquefaction apparatus from a constraction site of the module for a natural gas liquefaction apparatus to a construction site of the natural gas liquefaction apparatus; and separating the frame and the annex building arranged at installation positions, respectively, from each other by removing the coupling member at a time of installing the module for a natural gas liquefaction apparatus, which has been transported to the construction site, in the construction site.

5. The method of manufacturing a natural gas liquefaction apparatus according to claim 4, wherein the constructing a module for a natural gas liquefaction apparatus includes:

connecting, when the power supply apparatus is provided in the annex building, the power supply apparatus and the power consumption device to which electric power is supplied to each other through a feeder line, and connecting, when the control information output device is provided in the annex building, the control information output device and the controller to which the information on the operation control is output to each other through a signal line.

6. The method of manufacturing a natural gas liquefaction apparatus according to claim 4, wherein the constructing a module for a natural gas liquefaction apparatus includes:

configuring the annex building having a blastproof structure; and configuring the frame with a steel frame structure, wherein the frame does not have a blastproof structure.

* * * * *